US008305177B2

(12) United States Patent
Li et al.

(10) Patent No.: US 8,305,177 B2
(45) Date of Patent: Nov. 6, 2012

(54) MULTI FUNCTION MAGNETIC DECOUPLER

(75) Inventors: Chun Li, Plainview, NY (US); David Choit, Dix Hills, NY (US)

(73) Assignee: Dexter Magnetic Technologies, Inc., Elk Grove Village, IL (US)

( * ) Notice: Subject to any disclaimer, the term of this patent is extended or adjusted under 35 U.S.C. 154(b) by 231 days.

(21) Appl. No.: 12/652,621

(22) Filed: Jan. 5, 2010

(65) Prior Publication Data

US 2010/0176903 A1 Jul. 15, 2010

Related U.S. Application Data

(60) Provisional application No. 61/143,890, filed on Jan. 12, 2009.

(51) Int. Cl.
*H01F 7/02* (2006.01)

(52) U.S. Cl. ..... 335/306

(58) Field of Classification Search ..... 335/302–306; 24/303, 704.1; 340/572.9; 70/57.1
See application file for complete search history.

(56) References Cited

U.S. PATENT DOCUMENTS

| | | | | |
|---|---|---|---|---|
| 4,339,853 | A * | 7/1982 | Lipschitz | 70/57.1 |
| 4,527,310 | A * | 7/1985 | Vandebult | 70/57.1 |
| 6,084,498 | A * | 7/2000 | Stelter et al. | 335/306 |
| 7,791,486 | B2 * | 9/2010 | Ho | 340/572.3 |
| 7,921,524 | B2 * | 4/2011 | Maurer | 24/303 |
| 2007/0067971 | A1 * | 3/2007 | Nguyen et al. | 24/704.1 |

* cited by examiner

*Primary Examiner* — Bernard Rojas
(74) *Attorney, Agent, or Firm* — Richard A. Fagin

(57) ABSTRACT

A magnet assembly for decoupling a plurality of different types of magnetically operated security devices includes a center pole magnet having a magnetic orientation along a first direction. A plurality of magnets adjacent to and surrounding the center pole magnet define an opening above the center pole magnet. Each adjacent magnet has a magnetic orientation orthogonal to the first direction. An end pole magnet is disposed adjacent to one of the magnets adjacent to the center pole magnet. The end pole magnet has magnetic orientation opposed to the first direction.

17 Claims, 6 Drawing Sheets

MULTI FUNCTION MAGNETIC DECOUPLER

CROSS-REFERENCE TO RELATED APPLICATIONS

Priority is claimed from U.S. Provisional Application No. 61/143,890 filed on Jan. 12, 2009.

STATEMENT REGARDING FEDERALLY SPONSORED RESEARCH OR DEVELOPMENT

Not applicable.

BACKGROUND OF THE INVENTION

1. Field of the Invention

The invention relates generally to the field of magnetically released security devices. More specifically, the invention relates to magnetic decouplers that are usable with more than one type of magnetically releasable security device.

2. Background Art

There are various magnetically releasable security (antitheft) devices known in the art that are lockably coupled to an article to affix a surveillance tag to the article. The antitheft device is typically released from the article at the point of sale by using a magnetic decoupler. The most commonly used antitheft device is called a "hard tag." See, for example, U.S. Pat. No. 4,339,853 issued to Lipschitz. More recently, a double-pin or "double clutch" hard tag has been developed that requires a magnetic field with a greater longitudinal span than the single clutch or single pin hard tag. Examples of magnetic decouplers that can operate single clutch devices are shown in U.S. Pat. Nos. 5,959,520 and 6,084,498 issued to Stelter et al. and assigned to the assignee of the present invention.

Another widely used antitheft device is the "keeper box" used for CD/DVD, software and games. The keeper box requires a much wider magnetic field region to unlock. See, for example, U.S. Pat. No. 6,832,498 issued to Belden, Jr. et al. The field direction is horizontal, unlike the field for a typical hard tag, which is in the vertical direction with respect to the pin that locks the device to the article. Another example of a security device requiring a transverse magnetic field to decouple is shown in U.S. Patent Application Publication No. 2007/0067971 filed by Nguyen et al.

Typically, each type of antitheft device requires a specific type of magnetic field profile to release the device from the article. The point of sale operator would therefore require various types of magnetic decouplers for use with the various antitheft devices.

There is a need for a multifunction magnetic decoupler that is operable with various antitheft devices.

SUMMARY OF THE INVENTION

A magnet assembly according to one aspect of the invention for decoupling a plurality of different types of magnetically operated security devices includes a center pole magnet having a magnetic orientation along a first direction. A plurality of magnets adjacent to and surrounding the center pole magnet define an opening above the center pole magnet. Each adjacent magnet has a magnetic orientation orthogonal to the first direction. An end pole magnet is disposed adjacent to one of the magnets adjacent to the center pole magnet. The end pole magnet has magnetic orientation opposed to the first direction.

A magnet assembly for decoupling a plurality of types of magnetically operable security devices according to another aspect of the invention includes a center pole magnet having a substantially rectangular cross section and a magnetic orientation in a selected direction. A magnet is placed in contact with opposed sides of the center pole magnet. Endmost magnets are in contact with the opposed side magnets and the center pole magnet. The opposed side magnets and the endmost magnets each have magnetic orientation orthogonal to any other magnet in contact therewith.

The magnetic orientations of the magnets in the foregoing are selected to enable operation of at least two of a single clutch hard tag, a double clutch hard tag and a keeper box magnetically operated security device.

Other aspects and advantages of the invention will be apparent from the following description and the appended claims.

DETAILED DESCRIPTION

The present invention relates to an improved magnetic decoupler for use with a plurality of different types of magnetically releasable antitheft devices. The magnetic decoupler of the invention includes a plurality of magnets arranged with their magnetic orientations orthogonal to each other to increase the axial magnetic field gradient (axial magnetic field and its gradient) within a cavity formed by the magnetic decoupler. The gradient (the magnetic field and its gradient) is increased by superposition of the magnetic fields of each magnet.

1. Quadrature Magnets

Magnets arranged in quadrature (referred to for convenience herein as "quadrature magnets" or a "quadrature magnet assembly") are configured so that the magnetic orientation of each magnet is orthogonal to that of adjacent magnets. Such magnet configuration can provide an important performance improvement for applications using magnet assemblies, depending on the required magnetic flux density. Quadrature magnets result in greater force to weight ratio in Lorenz force applications and even greater improvements in force applications depending on magnetic attraction or repulsion, i.e., where force is proportional to flux density squared.

Quadrature magnets also provide improved magnetic field shapes in applications where, as in the present invention, optimal flux density gradients are desired. Quadrature magnet assemblies have been made possible by the development of "square" magnet materials. Square magnet materials have essentially a straight line in the second quadrant of the hysteresis curve, where the intrinsic coercivity value (as measured in Oersteds) exceeds the value of residual induction (as measured in Gauss). Magnets made of ferrite, samarium cobalt, and neodymium iron boron are currently the most widely used magnet materials of this type. Prior to the development of the foregoing "square" magnet materials it was impractical to use a quadrature magnet assembly because each magnet in an assembly not using such materials would demagnetize adjacent magnets to some extent when the magnet's induction exceeded the intrinsic coercivity of the adjacent magnets.

Individual magnet geometry is a major factor in selecting an application in which a quadrature magnet assembly is used because the individual magnet geometry establishes the operating point of the magnet. Individual magnet geometry establishes the self-demagnetizing factor of the magnet. Intrinsic coercivity less the value of the self-demagnetizing field determines the value of the external demagnetizing field the magnet can withstand without permanent loss of field strength. Magnetic circuit geometry determines the effectiveness of a group of magnets and ferrous components arranged to work together.

2. Specific Examples

Figure 1:
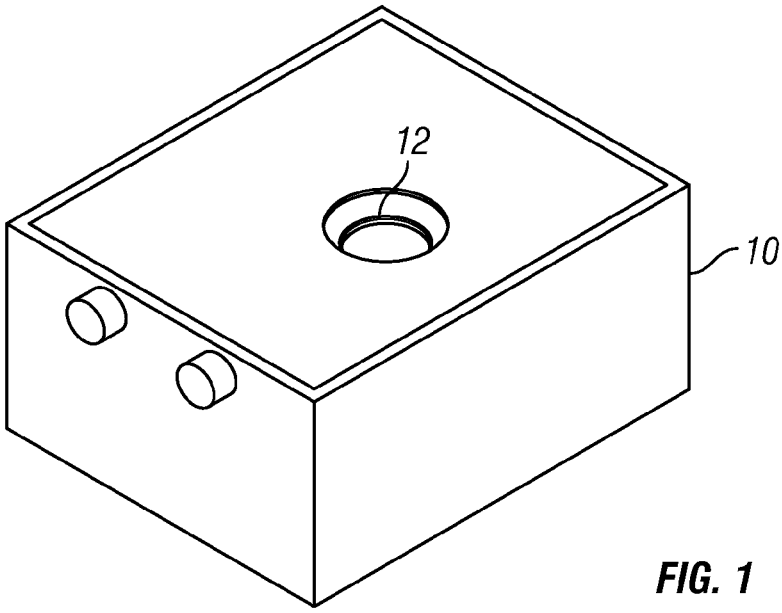
FIG. 1 shows one example of a decoupler according to the invention.
Figure 2:
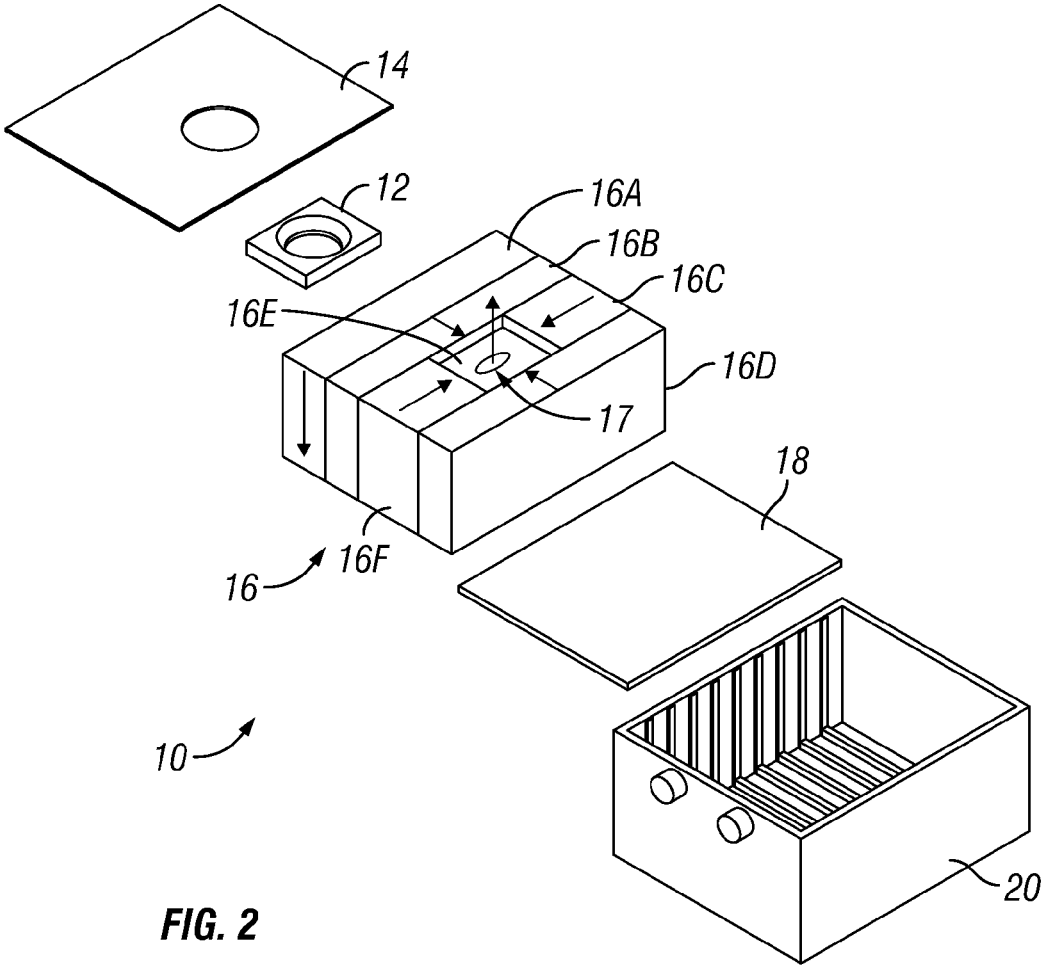
FIG. 2 shows an exploded view of the example of FIG. 1.

According to the present invention, a powerful magnetic structure having a strong axial field as well as a long range transverse field (i.e., orthogonal to the axial field) is provided. With reference to FIGS. 1 and 2, which show, respectively, an assembled view and an exploded view of an example decoupler 10, a magnet assembly 16 includes a short center pole magnet 16E along with a supporting insert 12. The center pole magnet 16E is magnetically oriented in a vertical direction. Vertical in the present context means in a direction along which a device may be inserted into a recess created by other magnets adjacent to the center pole magnet 16E, explained below. The center pole magnet 16E is cooperatively arranged with four adjacent magnets 16B, 16C, 16D, 16F each magnetically oriented orthogonally with respect to any other magnet in contact therewith to generate a strong axial magnetic field (along the magnetization direction of the center pole magnet 16E) for releasing security devices such as single clutch hard tags. A center recess (not shown separately) may be formed in the center pole magnet 16E to ensure that a single clutch hard tag security device is exposed to a magnetic field having an amplitude gradient of at least 66 Tesla per meter. The magnets adjacent to the center pole magnet 16E ("adjacent magnets") may include two short magnets, e.g., 16C and 16F wherein "short" means a direction transverse to vertical as that term is used herein, and two longer magnets 16B and 16D such that an opening 17 is defined above the center pole magnet 16E by the adjacent magnets. Example magnetic orientation of each of the adjacent magnets shown in FIG. 2 is indicated by an arrow on each adjacent magnet. The orientation of the adjacent magnets in the present example as shown in FIG. 2 has the effect of increasing the magnetic field (and its) gradient in the opening 17 beyond that induced by the center pole magnet 16E.

In the present example, another quadrature magnet 16A is located adjacent to one of the adjacent magnets, 16B in the present example, to the center pole magnet 16E. The endmost quadrature magnet 16A is oriented so that its magnetic field direction is opposite to the center pole magnet 16E. The assembly of quadrature magnets shown at 16A and 16B induces a transverse magnetic field that can be used to decouple, for example, a keeper box.

The magnets, 16A through 16F, may be assembled in a non-magnetic enclosure 20 formed from, for example, non-magnetic stainless steel, plastic or other non-ferromagnetic material. In some examples, the magnets may be underlain by a baseplate 18 formed from non-ferromagnetic material. In some examples, the baseplate 18 material can be magnetic to assist shielding of magnetic flux on the back side of the magnet assembly. The magnets and the insert 12 may be enclosed at the upper end of the decoupler 10 by a cover plate 14 formed form non-ferromagnetic material. The magnets, as explained above, may be made from a "square" magnet material such as ferrite, samarium cobalt or neodymium iron boron.

Figure 6:
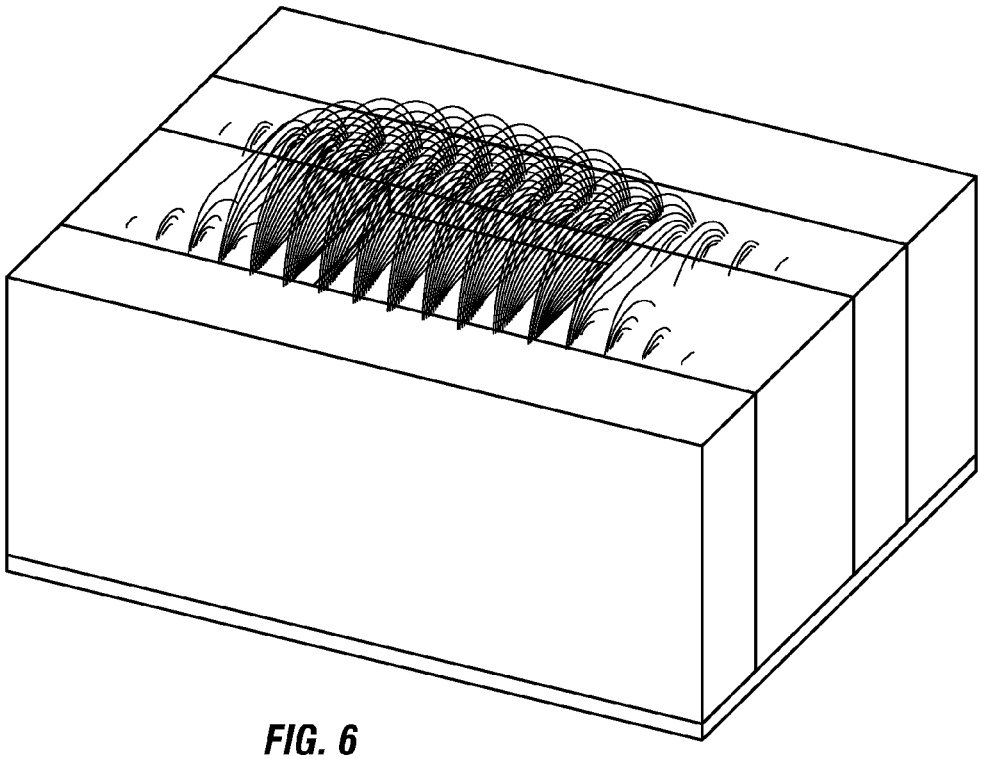

In a typical "double clutch" hard tag security device, two clutch pins are separated by a selected distance, typically 0.75 inch to one inch. With reference to FIG. 6, the elongated center pole magnet (16E in FIG. 2) and the adjacent quadrature magnets (16C and 16F in FIG. 2) provide a field region in excess of one inch long in the vertical direction.

Figure 3:
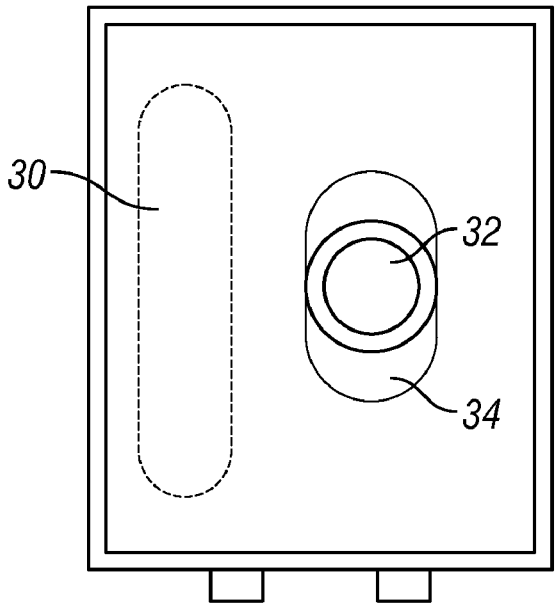
FIG. 3 shows a top view of the example of FIG. 2 and the locations of various magnetic field regions created by the magnet assembly shown in FIG. 2.

Regions with respect to the cover plate (14 in FIG. 2) for each of the magnetic fields to operate each type of security device are shown schematically in FIG. 3. For example, a single clutch hard tag may be released by insertion into the magnetic field region shown at 32. A double clutch hard tag may be released by moving it proximate the field region shown at 34. A keeper box may be released by moving it proximate the field region shown at 30.

Figure 4:
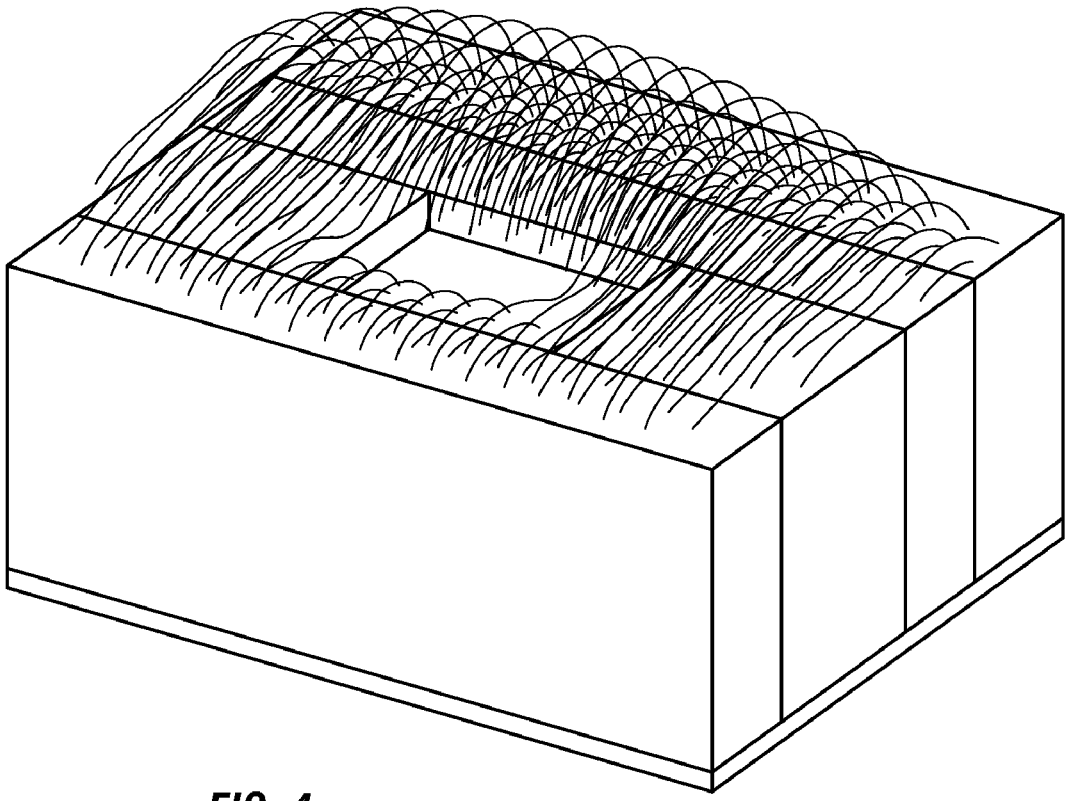
FIG. 4 shows a magnetic flux pattern above an example decoupler.

FIG. 4 shows the total magnetic flux pattern above the decoupler shown in FIG. 1 and FIG. 2. FIG. 4 shows that the flux follows a direction mainly outward from the center pole magnet (16E in FIG. 2). The magnetic flux configuration shown in FIG. 4 is a combination of the magnetic flux from the center pole (16E in FIG. 2) magnet and flux contributions from the quadrature magnets (16A, 16B, 16C, 16D and 16F in FIG. 2). The described arrangement of magnets generates a strong vertical field in and around the center pole as shown more specifically in FIG. 6 (which is a vertical magnetic field density plot). The flux then returns mainly to the side or end pole magnet (16A in FIG. 2). The returning flux path creates a strong and elongated transverse magnetic field above the junction between 16A and 16B as shown in FIG. 5 (which is a transverse magnetic field density plot).

Figure 5:
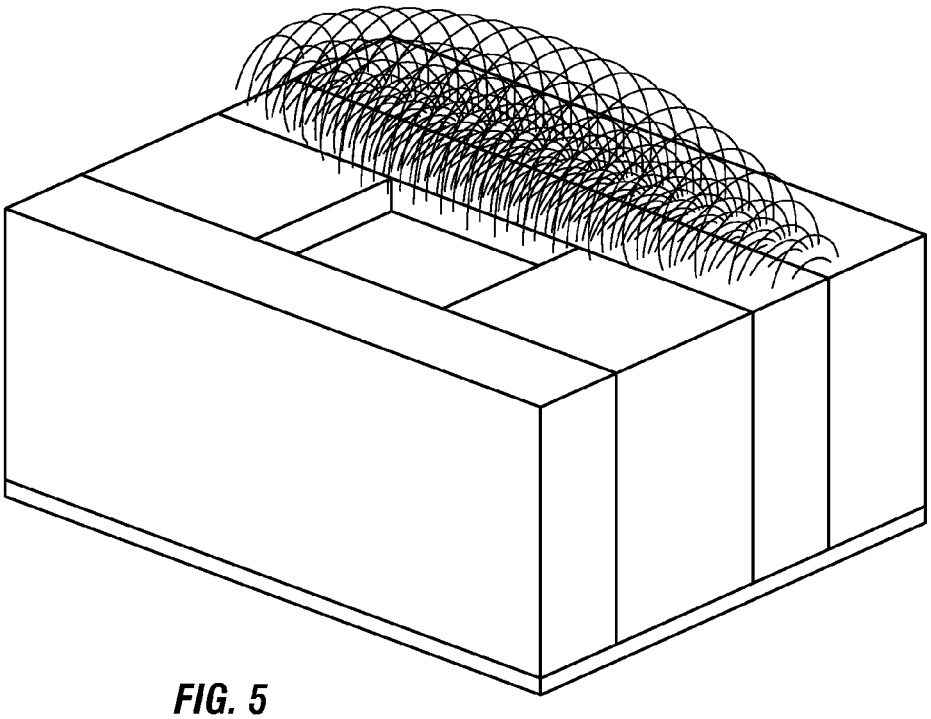
FIGS. 5 and 6 show distribution of portions of the magnetic field induced by the magnet assembly of FIG. 2.

With reference to FIGS. 2 and 5, the end pole magnet (16A in FIG. 2) magnet is added to provide a return path for the vertical magnetic field. The magnetization direction of the end pole magnet (16A in FIG. 2) is opposite to the orientation of the center pole magnet's (16E in FIG. 2) magnetization direction. Between the end pole magnet and the center pole magnet, a strong transverse magnetic field is formed, as shown by the field lines in FIG. 5. The transverse magnetic field is along the length of the magnetic decoupler and will unlock, for example, a security keeper box. The end pole magnet (16A in FIG. 2) also strengthens the vertical magnetic field from the center pole magnet (16E in FIG. 2).

Figure 7:
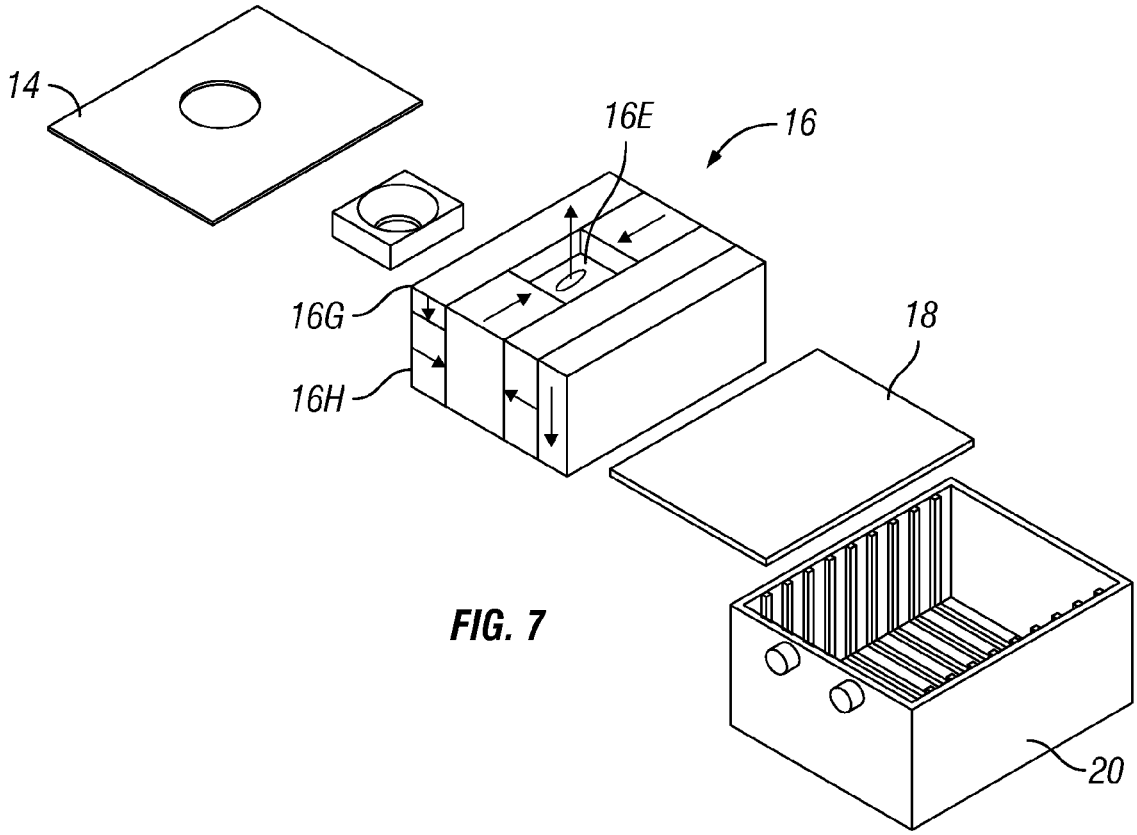
FIG. 7 shows an exploded view of another example of a multifunction decoupler.
Figure 7A:
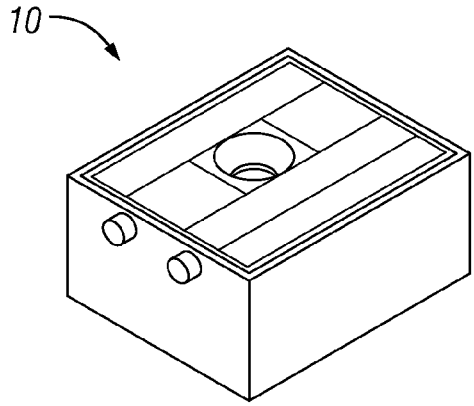
FIG. 7A shows an assembled view of the decoupler shown in FIG. 7.

In another example shown in exploded view in FIG. 7, one of the endmost quadrature magnets (e.g., 16D in FIG. 2) can be made from two individual magnets having orthogonal magnetic orientation. The top portion (i.e., the first magnet) shown at 16G in FIG. 7, is oriented opposite to the main vertical field from the center pole magnet 16E. The lower portion, i.e., the second magnet 16H, is oriented similarly to the endmost magnet in FIG. 2, that is, opposite to the orientation of the center pole magnet 16E. The foregoing magnet assembly and orientation will strengthen the vertical magnetic field further. The example shown in FIG. 7 is shown assembled in FIG. 7A.

Figure 8:
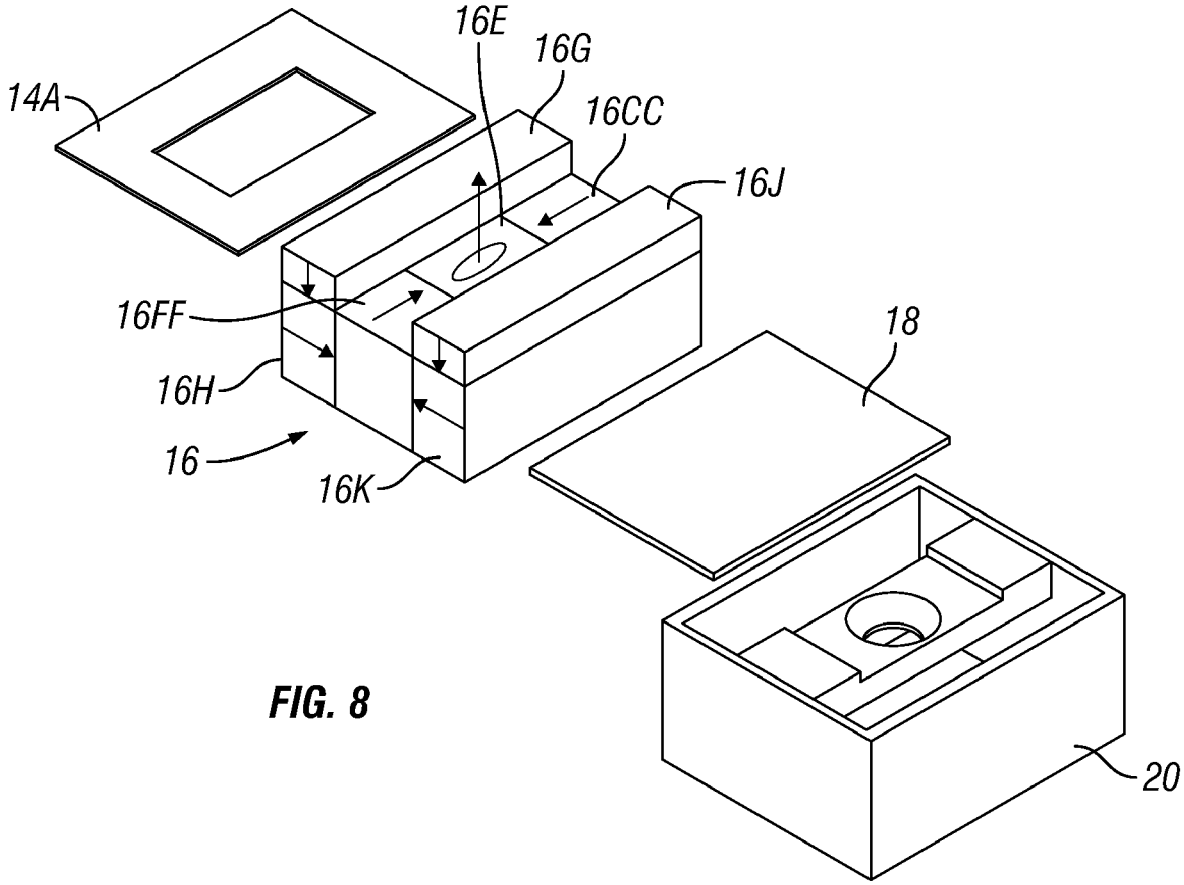
FIG. 8 shows an exploded view of another example of a multifunction decoupler.
Figure 8A:
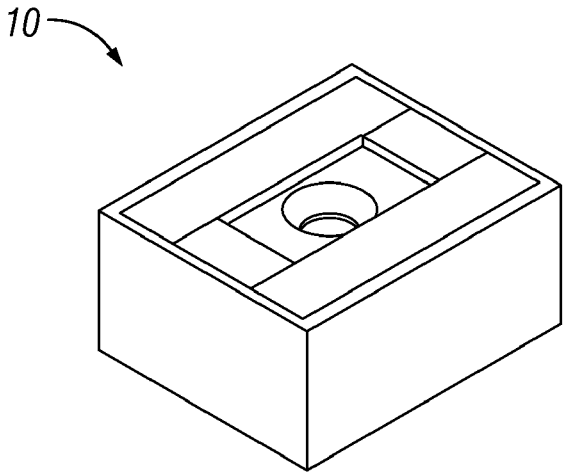
FIG. 8A shows an assembled view of the decoupler shown in FIG. 8.

In another example shown in FIG. 8, a recess is provided for double clutch hard tags by reducing the vertical dimension of two of the quadrature magnets, shown at 16CC, 16FF, adjacent to the center pole 16E, i.e., the short transverse dimension magnets. The cover 14A may include an elongated opening to accept double clutch hard tags. In the example shown in FIG. 8, both endmost magnets 16H, 16J are formed from two orthogonal magnets as explained with reference to FIG. 7. The long dimension orthogonal magnets are shown at 16G, 16H and 16J, 16K, and are magnetically oriented as shown by arrows thereon. The endmost magnets 16G, 16H, 16J, 16K may traverse a longer direction along the vertical dimension as shown and explained above, while the vertical dimension of the "short" quadrature magnets 16FF and 16CC may be similar to that of the example in FIG. 2. By using vertically longer and shorter quadrature magnets as shown in FIG. 8, recesses for both single clutch and double clutch hard tags are provided. The example of FIG. 8 provides an even stronger vertical field with a somewhat reduced magnitude transverse field for operating a keeper box. The example shown in FIG. 8 provides two cross field regions for operating a keeper box. The example shown in FIG. 8 is shown assembled in FIG. 8A.

Figure 9:
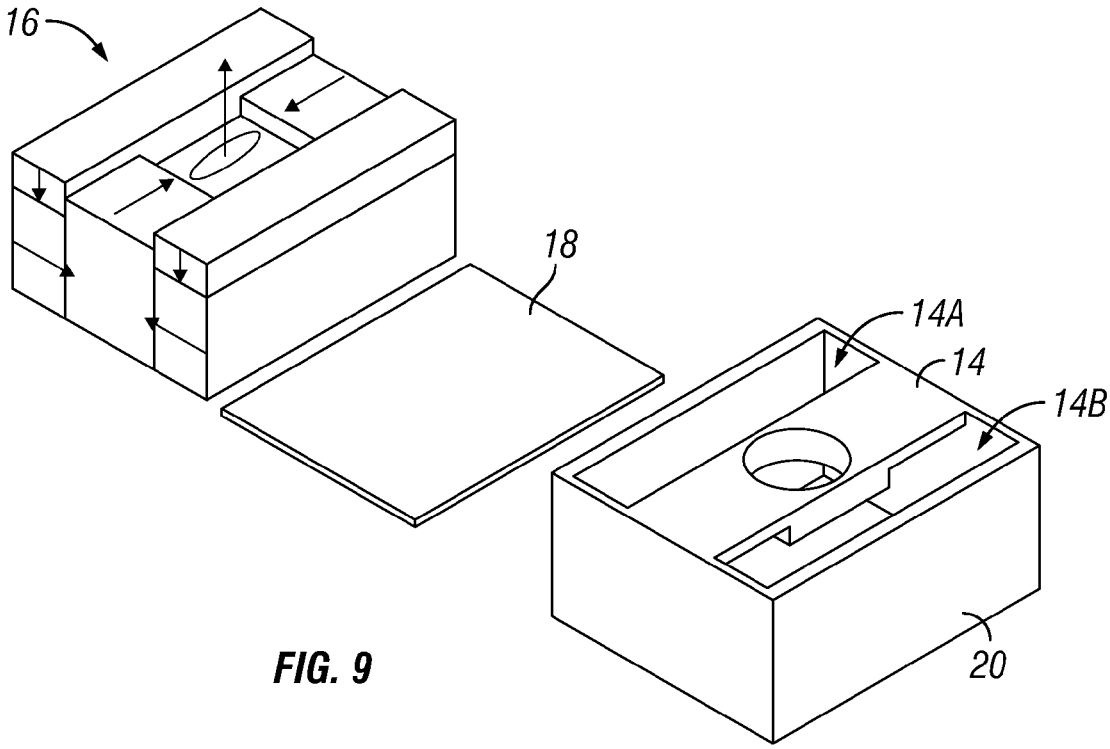
FIG. 9 shows an exploded view of another example of a multifunction decoupler.
Figure 9A:
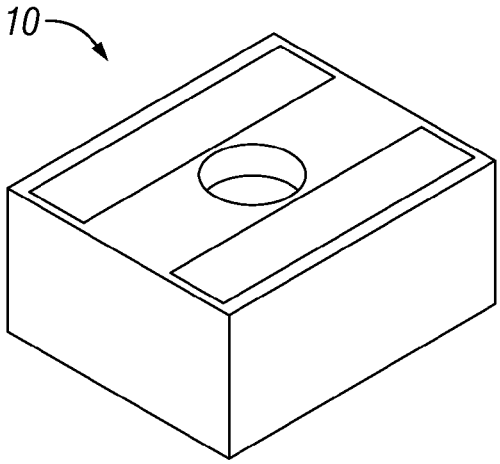
FIG. 9A shows an assembled view of the decoupler shown in FIG. 9.

A similar example is shown in FIG. 9, which includes two openings 14A, 14B in the cover 14 for operating keeper boxes. The example shown in FIG. 9 is shown assembled in FIG. 9A.

A magnet assembly as explained herein can operate a plurality of different types of magnetically operated security devices.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A magnet assembly for decoupling a plurality of different types of magnetically operated security devices, comprising:

a center pole magnet having a magnetic orientation along a first direction;

a plurality of magnets adjacent to and surrounding the center pole magnet, the adjacent magnets defining an opening above the center pole magnet, each adjacent magnet having a magnetic orientation orthogonal to the first direction; and an end pole magnet disposed adjacent one of the magnets adjacent to the center pole magnet, the end pole magnet having magnetic orientation opposed to the first direction.

2. The assembly of claim 1 wherein the adjacent magnets each have magnetic orientation orthogonal to the magnetic orientation of adjacent magnets thereto, the magnetic orientation of each adjacent magnet selected to increase a gradient of the axial magnetic field.

3. The assembly of claim 2 wherein the adjacent magnets comprise two short transverse dimension magnets and two long dimension magnets, such that the long dimension magnets each contact both of the short dimension magnets and define the opening above the center pole magnet.

4. The assembly of claim 3 wherein the long dimension adjacent magnets are formed from two orthogonally magnetically oriented magnets.

5. The assembly of claim 4 wherein one of the two orthogonally oriented magnets in each long dimension adjacent magnets is magnetically oriented opposite to the first direction.

6. The assembly of claim 3 wherein the end pole magnet is arranged in magnetic quadrature with the adjacent magnet adjacent thereto, such that a magnetic field is induced transverse to the magnetic field induced by the center pole magnet.

7. The assembly of claim 1 further comprising a cover made of non-magnetic material disposed above the magnet assembly, the cover including an opening disposed above the center pole magnet.

8. The assembly of claim 1 wherein the center pole magnet is shorter in a vertical direction than the adjacent magnets.

9. The assembly of claim 1 further comprising a base plate disposed on a lower surface of all magnets in the assembly, the base plate made from magnetic material to act as a flux closure.

10. The assembly of claim 1 wherein all the magnets are made from a square magnetic material.

11. The assembly of claim 10 wherein the square material comprises at least one of samarium cobalt and neodymium iron boron.

12. A magnet assembly for decoupling a plurality of types of magnetically operable security devices, comprising:

a center pole magnet having a substantially rectangular cross section and magnetic orientation in a selected direction;

a magnet in contact with two of the opposed sides of the center pole magnet; and endmost magnets in contact with the opposed side magnets and with the center pole magnet, the opposed side magnets and the endmost magnets having magnetic orientation orthogonal to any other magnet in contact therewith.

13. The magnet assembly of claim 12 wherein each of the endmost magnets comprises two magnets in contact with each other, the two magnets in contact with each other magnetically oriented orthogonally with any other magnet in contact therewith.

14. The magnet assembly of claim 12 further comprising an end pole magnet in contact with one of the endmost magnets, a magnetic orientation of the end pole magnet opposed to the selected direction of the center pole magnet.

15. The assembly of claim 12 further comprising a base plate disposed on a lower surface of all magnets in the assembly, the base plate made from magnetic material to act as a flux closure.

16. The assembly of claim 12 wherein all the magnets are made from a square magnetic material.

17. The assembly of claim 16 wherein the square material comprises at least one of samarium cobalt and neodymium iron boron.

* * * * *